United States Patent [19]

Richards

[11] 3,944,126

[45] Mar. 16, 1976

[54] CONTAINER

[75] Inventor: Frank P. Richards, Kansas City, Mo.

[73] Assignee: Phillips Petroleum Company, Bartlesville, Okla.

[22] Filed: Oct. 2, 1974

[21] Appl. No.: 511,271

[52] U.S. Cl. ..... 229/4.5; 229/48 T
[51] Int. Cl.[2] ..... B65D 3/04; B65D 3/14
[58] Field of Search ..... 229/4.5, 5.5, 5.6, 48 T

[56] References Cited

UNITED STATES PATENTS

| | | | |
|---|---|---|---|
| 2,347,236 | 4/1944 | Barbieri | 229/4.5 |
| 2,409,655 | 10/1946 | Annen | 229/5.6 |
| 2,496,043 | 1/1950 | Farrell | 229/48 T X |
| 2,883,045 | 4/1959 | Abramson | 229/5.5 X |
| 3,018,212 | 1/1962 | Chinn | 229/4.5 X |
| 3,070,225 | 12/1962 | Schwartz | 229/48 T X |
| 3,157,339 | 11/1964 | Negoro | 229/5.5 |
| 3,365,111 | 1/1968 | McNair et al. | 229/17 G |
| 3,411,542 | 11/1968 | Walsh et al. | 229/4.5 X |
| 3,454,208 | 7/1969 | Amberg | 229/4.5 |

*Primary Examiner*—Davis T. Moorhead

[57] ABSTRACT

A container is formed from a generally rectangular blank of paperboard or the like which is rolled to form a cylindrical or conically shaped side wall. A circular disc is secured to one end of the side wall to form an end closure. Leakage at the junction between the side wall seam and the disc is eliminated by positioning a bead of sealant material at this junction. Blanks employed to construct the container are also disclosed.

3 Claims, 5 Drawing Figures

CONTAINER

Increasing use is being made in the packaging industry of containers formed of relatively low-priced paperboard, cardboard and the like. Cylindrical containers formed of these materials are often constructed by spirally wrapping a strip of material on a mandrel. However, this method of construction requires the use of rather complex machinery and results in a container with a relatively long spiral seam. Another procedure for forming cylindrical containers involves forming the side wall from a rectangular blank which is rolled on a mandrel to form the cylindrical side wall. A circular disc is secured to one end to form the end closure. While this procedure is satisfactory for many applications, leaks may develop at the junction between the side wall seam and the end disc.

In accordance with one embodiment of this invention, an improved cylindrical container is constructed from a rectangular side wall blank and a circular end disc having a depending skirt. Leakage at the junction between the side wall seam and the bottom seam is eliminated by positioning a bead of sealant material at this junction. In one embodiment, the sealant is placed on the side wall blank before the cylindrical container is formed. In another embodiment, the sealant is placed on the end closure disc before the container is formed. Blanks of paperboard and the like to be used in forming the container of this invention are also provided.

In the accompanying drawing.

Figure 1:
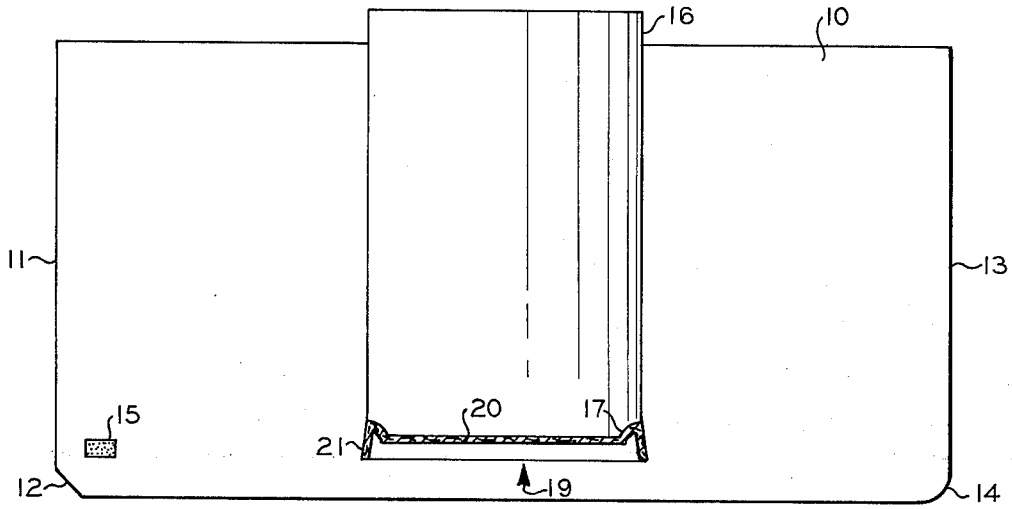
FIG. 1 illustrates blanks employed to form the container of this invention and a mandrel employed in the container assembly.

Referring now to the drawing in detail and to FIG. 1 in particular, there is shown a generally rectangular blank 10 which is formed of paperboard, cardboard or the like. The surfaces of this blank are advantageously coated with a thermoplastic material such as polyethylene or a wax which reduces the permeability of the blank and which assists in sealing the edges of the blank when the container is formed. The left-hand edge 11 of blank 10 is provided with a cutoff corner 12, and the right-hand edge 13 is provided with a rounded corner 14. Sealant material 15, to be described in greater detail hereinafter, is positioned on the inner face of blank 10 near corner 12.

Figure 3:
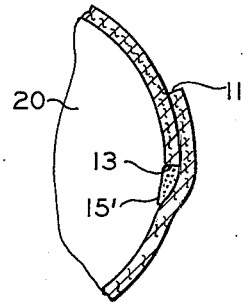
FIG. 3 is a view taken along line 3—3 in FIG. 2.
Figure 2:
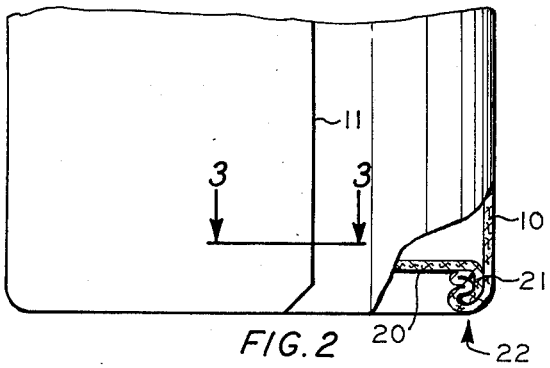
FIG. 2 is a view, shown partially in section, of one end of a container of this invention.

The side wall of the container is formed by heating edges 11 and 13 of blank 10 and wrapping blank 10 around a cylindrical mandrel 16, which is provided with a recess 17 at the lower edge. A bottom closure 19 for the container comprises a generally cylindrical disc 20 of coated paperboard, cardboard or the like, which has a depending skirt 21 thereon. This end closure is positioned in engagement with mandrel 16, as illustrated. Edge 13 is rolled onto the mandrel, followed by edge 11, so that edge 11 overlaps edge 13, as illustrated in FIG. 3. Pressure is applied to seal these edges. The bottom edge of blank 10 and the end closure are heated and a crimping roller, not shown, then engages the lower edge of blank 10 and forces it into engagement with skirt 21 to form a crimped seal 22, such as illustrated in FIG. 2. The heat supplied to edges 11 and 13 of blank 10 and to the region of crimp 22 serves to melt the coating on the blank and on end closure 19 to form fluid-tight seals.

In accordance with this invention, sealant 15 is positioned so as to fill the space between edge 13 and side 11 at the region this seam joins crimp 22. The application of heat in the sealing process serves to melt sealant 15 so as to form a seal at the junction of the seam and depending skirt of the end closure. The final solidified sealant 15' is illustrated in FIG. 3.

Figure 4:
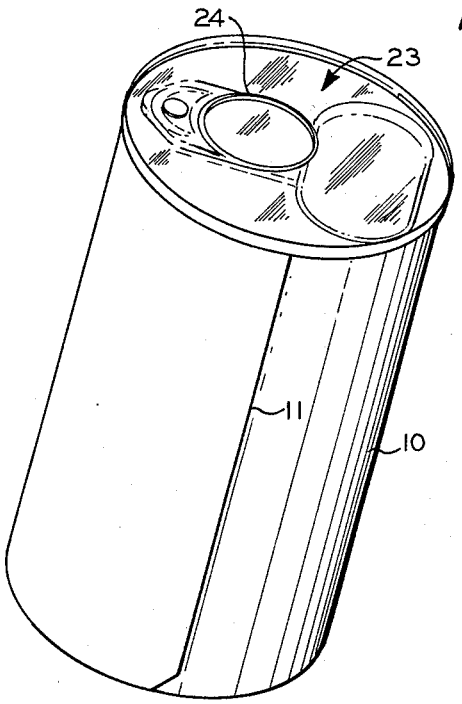
FIG. 4 illustrates a container of this invention having a second end closure thereon.

The second end of the container can be closed after filling by any suitable end closure. In the embodiment illustrated in FIG. 4, an end closure 23 provided with a pull ring 24 is crimped to the top of the container. However, other types of end closures such as solid discs and those containing pour spouts or tear tabs can also be employed.

Figure 5:
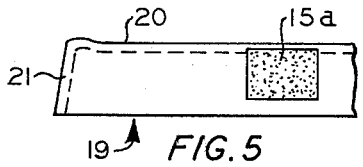
FIG. 5 illustrates a blank employed to form an end closure of the container.

A second embodiment of the sealing construction of this invention is illustrated in FIG. 5 wherein sealant **15*a* is deposited on end closure 19. This sealant is positioned on the end closure in the region of the seam which is formed by the overlapped edges of blank 10**. Such a sealant can be positioned on the end closure before the end closure is positioned on the mandrel, but this requires that the end closure be aligned carefully on the mandrel. Another alternative involves depositing the sealant on the end closure after it is positioned on the mandrel and before the side wall blank is wrapped onto the mandrel.

The sealant 15 or **15*a* preferably is a heat-sensitive material which melts when the container is formed and thereby fills the joint at the seam. Various thermoplastic resins and waxes and hot melt adhesives can be employed. Examples of suitable materials include paraffin wax, gelled lacquer, microcrystalline wax, polyethylene and the like. The sealant should be carefully placed on the side wall blank or the bottom closure so as to fill the joint when the container is assembled. A minimum amount of sealant to provide the necessary seal should be employed. In some instances, the sealant can be applied immediately before the container is assembled. This minimizes any stacking problems that may be encountered if excessive sealant should be placed on the blanks. In general, the spot of sealant 15 or 15*a*** extends less than about one-fifteenth of the circumference of the container.

This invention has been described in conjunction with the manufacture of cylindrical containers from rectangular side wall blanks. However, it should be apparent that containers having the shape of a frustum can also be made from blanks which, while being generally rectangular, are fan-shaped with curved upper and lower edges as illustrated in U.S. Pat. No. 3,157,339, for example.

While this invention has been described in conjunction with presently preferred embodiments, it should be evident that it is not limited thereto.

What is claimed is:

1. A container having a cylindrical or a conically shaped side wall constructed from a generally rectangular blank which has one bottom corner cut off and the other bottom corner rounded, said blank being formed into a container side wall with one side edge of the blank overlapping the opposite side edge to form a side wall seam with the rounded corner on the inside, an end closure member comprising a generally cylindrical disc having a skirt depending therefrom which is crimped to the bottom of the blank to form a bottom seam, and means to prevent leakage at the joint which is formed at the junction of the side wall seam and the bottom seam comprising a bead of sealant positioned at said junction and adhering to the side wall and bottom closure, said bead of sealant being of such size as to fill the joint which formed at said junction.

2. The container of claim 1 wherein said blank and said bottom closure are formed of paperboard or the like having a coating of a thermoplastic material on the surfaces thereof.

3. A blank to be used in the manufacture of a container comprising a generally rectangular sheet of paperboard or the like coated with a thermoplastic material and having two side edges, a bottom edge and a top edge, the corner of said bottom edge and one side edge being cut off and the corner of said bottom edge and the second side edge being rounded, and a bead of sealant material disposed on one surface of said sheet adjacent the cut off corner but spaced from said one side edge and said bottom edge so that the sealant material is positioned at the side seam when the blank is formed into the side wall of a container by lapping said one side edge over said second side edge to form said side seam.

* * * * *